United States Patent [19]

Pfister et al.

[11] 4,047,945

[45] Sept. 13, 1977

[54] XEROPRINTING MASTER AND PROCESS

[75] Inventors: Gustav R. Pfister, Webster; David J. Williams, Fairport, both of N.Y.

[73] Assignee: Xerox Corporation, Stamford, Conn.

[21] Appl. No.: 550,258

[22] Filed: Feb. 18, 1975

[51] Int. Cl.[2] ..... G03G 5/04

[52] U.S. Cl. ..... 96/1 R; 96/1.4; 96/1.5 N; 96/1.8; 252/501

[58] Field of Search ..... 96/1 R, 1.4, 1.5, 1.8; 252/501

[56] References Cited

U.S. PATENT DOCUMENTS

| | | | |
|---|---|---|---|
| 3,121,006 | 2/1964 | Middleton et al. | 96/1.5 |
| 3,174,855 | 3/1965 | Gray | 96/1.5 |
| 3,251,686 | 5/1966 | Gundlach | 96/1.5 |
| 3,545,969 | 12/1970 | Herrick et al. | 96/1.5 X |
| 3,647,427 | 3/1972 | Hanada et al. | 96/1.5 |
| 3,769,010 | 10/1973 | Hanada et al. | 96/1.5 |
| 3,813,243 | 5/1974 | Kitajima et al. | 96/1.5 |
| 3,879,201 | 4/1975 | Williams et al. | 96/1 R X |
| 3,915,076 | 10/1975 | Gotoda | 96/1.8 |
| 3,953,206 | 4/1976 | Weigl | 96/1 R X |
| 3,953,207 | 4/1976 | Horgan | 96/1.5 X |

OTHER PUBLICATIONS

Schaffert, "Multiple-Copy Printing Process", IBM Tech. Discl. Bull., vol. 1, No. 4, Dec. 1958, p. 4.

*Primary Examiner*—Edward C. Kimlin

*Attorney, Agent, or Firm*—James J. Ralabate; James P. O'Sullivan; John H. Faro

[57] ABSTRACT

A xeroprinting master capable of preparation of multiple copies of an original without reimaging and without permanent modification of the master itself. This xeroprinting master consists essentially of a conductive base member, a non-persistent photoconductive insulating layer, a persistent photoconductive insulating layer and a dielectric layer; these layers being arranged relative to one another in the order of their listing. A latent electrostatic image can be created upon the surface of the dielectric layer by initially exposing the persistent photoconductive insulating layer to an image pattern, sensitizing the surface of the dielectric layer in the dark by charging to a constant surface potential, followed by blanket exposure of the non-persistent photoconductive insulating layer; the wavelength of light used in blanket exposure of the non-persistent photoconductive insulating layer being substantially non-activating of the persistent photoconductive insulating layer. Upon collapse of the field across the non-persistent photoconductive layer, a latent image pattern is generated upon the surface of the dielectric film. This image pattern can be rendered visible by development with dry or liquid developers. Subsequent to development and removal of residual toner particles, the latent image pattern can be regenerated simply by charging.

5 Claims, 1 Drawing Figure

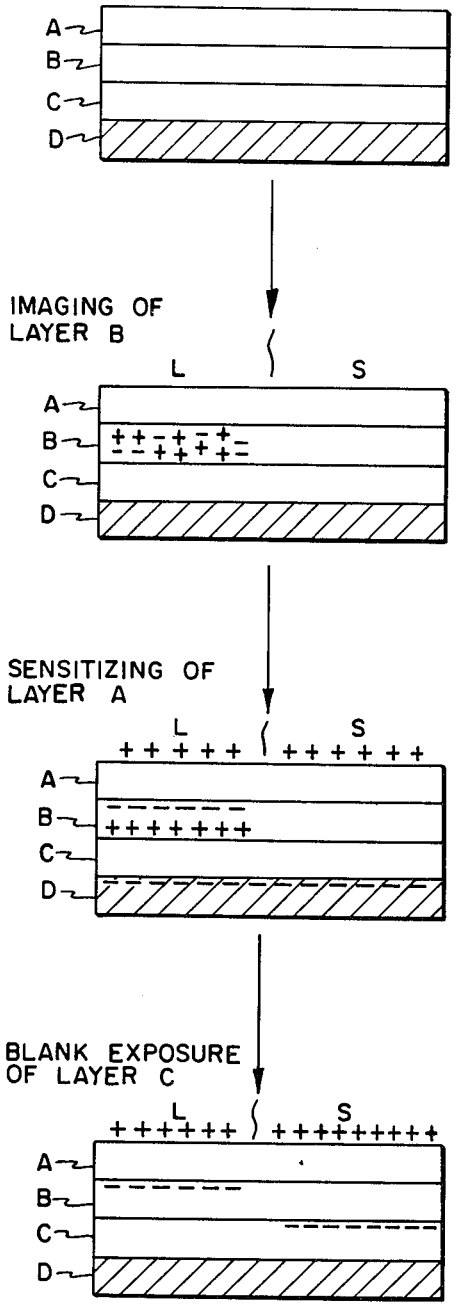
A
B
C
D
IMAGING OF LAYER B
L
S
SENSITIZING OF LAYER A
BLANK EXPOSURE OF LAYER C

XEROPRINTING MASTER AND PROCESS

BACKGROUND OF THE INVENTION

1. Field of the Invention

This invention relates to an article and to a process employing said article. More specifically, this invention involves a xeroprinting master suitable for use in a xeroprinting process.

2. Description of the Prior Art

The formation and development of images on an imaging layer of photoconductive materials by electrostatic means is well known. The best known of the commercial processes, more commonly known as xerography, involves forming a latent electrostatic image on the imaging layer of an imaging member by first uniformly electrostatically charging the surface of the imaging layer in the dark and then exposing this electrostatically charged surface to a light and shadow image. The light struck areas of the imaging layer are thus rendered relatively conductive and the electrostatic charge selectively dissipated in these irradiated areas. After the photoconductor is exposed, the latent electrostatic image on this image bearing surface is rendered visible by development with charged finely divided colored electroscopic powder material, known in the art as "toner". This toner will be principally attracted to those areas on the image bearing surface having a polarity opposite to the charge on said toner particles and thus form a visible powder image.

The developed image can then be read or permanently affixed to the photoconductor in the event that the imaging layer is not to be reused. This latter practice is usually followed with respect to the binder-type photoconductive films (e.g. zinc oxide pigment dispersed in a film forming insulating resin) where the photoconductive layer is also an integral part of the finished copy, U.S. Pat. Nos. 3,121,006 and 3,121,007.

In so-called "plain paper" copying systems, the latent image can be developed on the imaging surface of a reusable photoconductor or transferred to another surface, such as a sheet of paper, and thereafter developed. When the latent image is developed on the imaging surface of a reusable photoconductor, it is subsequently transferred to another substrate and then permanently affixed thereto. Any one of a variety of well-known techniques can be used to permanently affix the toner image to the copy sheet, including overcoating with transparent films and solvent or thermal fusion of the toner particles to the supportive substrate. It is not generally possible to prepare more than one copy of an original from a single latent image, since the latent image is partially neutralized by development and progressively decays with the passage of time between the development and transfer of each successive copy. This neutralization and decay results in a reduction in contrast potential between the latent image pattern and the non-imaged areas on the photoreceptor and thus a reduction in image density in each successive copy. The omission of a cleaning step in such a multiple reproduction copying system also results in further gradual deterioration in copy quality due to accumulation of toner residues on the non-imaged areas of the photoconductive layer.

In addition to the classical type of electrostatographic imaging systems discussed above wherein latent image formation takes place directly on the photoconductive insulating layer, the literature also discloses several processes wherein latent image formation results from inducement of a charge pattern across the dielectric overcoating, U.S. Pat. Nos. 3,234,019 (to Hall); 3,653,064 (to Inoue); and 3,676,117 (to Kinoshita). The ability of such induction imaging systems to prepare multiple copies of an original from a latent image is also limited by the same factors discussed above with regard to more conventional types of electrophotographic copying methods. It has been suggested, that where the latent image pattern can be isolated from the ambient environment and the charged electroscopic toner particles used in development of said image, such latent image can be used for preparation of multiple copies without repetition of the latent image formation sequence, U.S. Pat. No. 3,429,701 (to Koehler). However, without at least some periodic renewal of the charge pattern at the interface of the dielectric and the photoconductive insulating layer, the field intensity across the dielectric layer will gradually begin to decline as a consequence of development of each successive copy. This is due, in part, to the gradual build-up of a counter charge corresponding to the lines of force of the image pattern on the surface of the dielectric layer. As this countercharge increases, the contrast potential between the latent image pattern and the background areas of the dielectric layer will diminish to a point where it is no longer possible to effectively develop the image pattern.

The use of persistent photoconductors in electrostatographic imaging members and methods has been previously disclosed, U.S. Pat. No. 3,545,969. The persistent photoconductive imaging members disclosed in U.S. Pat. No. 3,545,969 are described as capable of preparation of multiple copies from a single exposure. This is reportedly achieved (column 6, line 46 to column 7, line 27) by initially exposing the persistent photoconductive imaging member to an image pattern followed by charging the exposed surface of said member. The charged surface of the persistent photoconductive imaging member is thereafter contacted with an insulating sheet, the surface of the sheet not in contact with the photoconductive imaging member also charged and the insulating sheet and the persistent photoconductive imaging member subsequently separated. Upon separation, a charge pattern is formed on the surface of the insulating sheet formerly in contact with the surface of the persistent photoconductive imaging member. This image pattern on the insulating sheet can be subsequently developed by standard techniques. The above imaging process can reportedly be repeated in excess of 100 times without reimaging of the persistent photoconductor. The quality of the image obtained by the above process is apparently dependent upon the type of charging means used in creation of a biasing potential on the surface of the insulating sheet not in contact with the persistent photoconductive imaging member. Where the means for charging the insulating member is a corona electrode, copy quality is marginal. In the event that charging of the insulating sheet is achieved with a conductive roller, copy quality is reportedly substantially improved. Upon separation of the insulating sheet from the persistently imaged photoconductive layer, air molecules at the point of separation are selectively ionized and thereby form a latent image pattern in the surface of the insulator in substantial conformity with the persistent image pattern. As a consequence of such ionization of the air molecules at the point of separation of these two films, the intensity of the image pattern within the persistently imaged photoconductive layer will be partially diminished. Such diminution in intensity of the persistent image pattern will be occasioned upon repetition of the copying cycle and thus ultimately the image information recorded within this layer will no longer be reproducible.

Accordingly, it is the object of this invention to remove the above as well as related deficiencies in the prior art.

More specifically, it is the principal object of this invention to provide a persistently photoconductive imaging member suitable for use in preparation of multiple copies from a single exposure to image information.

It is another object of this invention to provide a persistently photoconductive imaging member suitable for use in an induction type imaging system.

It is yet another object of this invention to provide an overcoated persistently photoconductive imaging member.

SUMMARY OF THE INVENTION

The above and related objects are achieved by providing an electrophotographic imaging member which consists essentially of a conductive substrate, a non-persistent photoconductive insulating layer operatively disposed with respect to said substrate, a persistent photoconductive insulating layer contiguous with the non-persistent photoconductive insulating layer and an unpigmented dielectric layer overcoating the free surface of the persistent photoconductive insulating layer. This imaging member is suitable for use in preparation of multiple copies of an original without repeated re-imaging of the member subsequent to initial exposure to original image input. This is achieved by initially exposing the persistent photoconductive insulating layer to image information. Subsequent to such exposure, the surface of the dielectric layer is charged in the dark to a constant surface potential. Following such sensitization, the non-persistent photoconductive insulating layer is subjected to blanket exposure with activating electromagnetic radiation, whereby the relative capacitance in the imaged and non-imaged areas of the imaging member is shifted thus producing a latent image pattern upon the surface of the dielectric layer. The wavelength of light used in blanket exposure of the non-persistent photoconductive insulating layer must be substantially non-activating of the persistent photoconductive insulating layer. Subsequent to development, transfer and cleaning of the surface of the dielectric layer, a latent image pattern may be regenerated simply by recharging and blanket exposure in the manner described above. No re-imaging of the member is necessary.

BRIEF DESCRIPTION OF THE DRAWINGS

The figure is a diagramatic illustration of an imaging process using the four layered imaging member of this invention.

DESCRIPTION OF THE INVENTION INCLUDING PREFERRED EMBODIMENTS

The imaging members of this invention are prepared by conventional film forming and/or vacuum evaporation techniques. In a representative fabrication sequence, a thin film of solvent resistent insulating material (layer A of FIG. 1), such as Mylar, is coated with a photoconductive insulating layer (layer B of FIG. 1) (hereinbefore and hereinafter referred to as "persistent photoconductive insulating layer") capable of persisting in an elevated state of conductivity for a prolonged period subsequent to the illumination thereof. This persistent photoconductive insulating layer is then further overcoated with a second photoconductive insulating layer (layer C of FIG. 1) (hereinbefore and hereinafter referred to as "non-persistent photoconductive insulating layer") which is characterized as having a spectral response beyond the range of spectral response of the persistent photoconductive insulating layer and the ability to rapidly return to its relatively insulating state subsequent to the illumination thereof. The non-persistent photoconductive insulating layer may comprise amorphous selenium. The free surface of this non-persistent photoconductive insulating layer can then be further overcoated with a conductive film (layer D of FIG. 1) such as aluminum, by standard vacuum evaporation techniques. The above type of photoreceptor fabrication procedure is more completely described in U.S. Pat. No. 3,251,686 (to Gundlach), which is hereby incorporated by reference in its entirety.

An imaging member of the type shown in FIG. 1 is suitable for use in an imaging process involving preparation of multiple copies of an original without re-exposure of the member to the image information between reproduction cycles. In such a process, the persistent photoconductive imaging layer of the imaging member, (layer B) is initially exposed to image information at a wavelength and for an interval sufficient to render this layer persistently conductive for a period of at least sixty seconds (and preferably significantly longer) subsequent to the termination of illumination. The surface of the dielectric layer (layer A) is then charged in the dark to a constant surface potential ($V_o$). Because the persistent photoconductive insulating layer in the image areas is no longer insulating it cannot sustain an electric field, and thus, the field division across layers A, B and C of the composite varies from the imaged area to the non-imaged area.

The non-persistent photoconductive insulating layer (layer C) is now subjected to blanket exposure with activating electromagnetic radiation thereby reducing the field across this layer. Since the charge density on the surface of the dielectric layer (layer A) remains constant throughout this procedure, the surface potential must change in both the imaged and non-imaged areas in order to accomodate the reduction in field across layer C. The interface between the persistent photoconductive insulating layer and the non-persistent photoconductive insulating layer must provide a barrier to injection of charge carriers in the non-imaged areas in order to maintain the field across layer B and thereby generate a contrast potential upon the surface of the dielectric layer sufficient for the formation of a developable latent image. The magnitude of the contrast potential can be controlled by controlling the relative thicknesses and dielectric constants of the individual layers of imaging member.

For the purpose of further illustration, the contrast potential on the surface of the dielectric layer can be calculated by the following series of equations. In order to simplify such calculations, it is assumed for the purpose of this illustration that: (a) the fields distribute themselves uniformly across layers A, B and C; (b) layer B is substantially incapable of sustaining a field in those areas of the layer which are subjected to selective exposure to activating electromagnetic radiation; and (c) the field across layer C totally collapses upon blanket exposure of this layer.

The contrast potential for an imaging member of this invention can be expressed by the following equation $$\frac{\Delta V}{V_o} = \frac{ab}{1 + a + b} \quad (1)$$

$$\text{where } a = \frac{\epsilon_A}{\epsilon_B} \times \frac{t_B}{t_A}; b = \frac{\epsilon_A}{\epsilon_C} \times \frac{t_C}{t_A}$$

$t_A$, $t_B$ and $t_C$ represent the thickness of layers A, B and C respectively, and $\epsilon_A$, $\epsilon_B$ and $\epsilon_C$ represent the dielectric constants of layers A, B and C respectively.

It therefore will be appreciated that the contrast potential on the surface of the dielectric layer will vary proportionally with the charging voltage and be further dependent upon the relative thickness and dielectric constant of layers A, B and C.

If equation (1) is rewritten as equation (2)

$$\frac{\Delta V}{V_o} = \frac{1}{n} \quad (2)$$

it then follows that the thickness $t_A$, $t_B$ and $t_C$ and the dielectric constants $\epsilon_A$, $\epsilon_B$ and $\epsilon_C$ will have the following relationship $$a \geqq \left(\frac{n}{n-1}\right)^2 \quad (3a)$$

$$b > \frac{1}{n-1} \quad (3b)$$

For a given contrast potential ($\Delta V$), initial potential ($V_o$) and set of dielectric constants ($\epsilon$), the relative thickness of the various layers can be determined within the limits of equations 3a and 3b. The only remaining requirement in such thickness selection being that for a given set of dielectric thicknesses the electric field across the various layers not exceed their individual breakdown values.

The Examples which follow further define, describe and illustrate the imaging members and imaging processes of this invention. The techniques and equipment used in both preparation and evaluation of the imaging members in the imaging processes of these Examples are standard or as hereinbefore described. Parts and percentages appearing in such Examples are by weight unless otherwise indicated.

EXAMPLE I

About 24 parts by weight poly(N-vinylcarbazole), available from BASF under the tradename Luvican, 1 part by weight o-dinitrobenzene and 1 part by weight trichloroacetic acid (anhydrous solids) are dissolved in 50 milliliters tetrahydrofuran, and the resulting solution draw down coated on a 2 μm thick sheet of Mylar 6 inches square. Sufficient solution is transferred to the Mylar to provide a coating having a dry film thickness of approximately 30 microns. The coating is thereafter allowed to dry until substantially free of solvent residues. The coated Mylar is then transferred to a vacuum evaporation chamber and a film of $As_2Se_3$ vacuum deposited upon the free surface of the coating. After the amount of $As_2Se_3$ deposit has attained a thickness of approximately 90 microns, a shutter is interposed between the coating and the crucible containing the molten $As_2Se_3$, thereby terminating further deposition. The composite film thus produced is thereafter transferred to a second vacuum evaporation chamber and a conductive coating of aluminum vacuum deposited upon the free surface of the selenium layer. The four-layered plate thus produced is transferred to a light tight oven which is being maintained at 100° C. The plate is heated in the oven for approximately 15 seconds, transferred (still in the dark) to a copy board and image information projected onto the imaging member from a distance of 12 centimeters for a period of 30 seconds. The source of illumination is a 150 watt high intensity photoflood lamp (General Electric Model BBA). An appropriate band pass filter is disposed intermediate between the light source and the transparency in order to insure that the wavelength emitted is only activating of the persistent photoconductive insulating layer. After exposure, the dielectric surface of the imaging layer is charged to a constant surface potential of 1000 volts with a corona electrode set at a potential of 7000 volts relative to ground. The imaging member is then blanket exposed so as to render the selenium layer photoconductive and thereby collapse the field across this layer. The wavelength of light used in illumination of the photoconductive imaging member is similarly filtered as described above so as to avoid activation of the non-persistent photoconductive insulating layer. A contrast potential of at least 500 volts thereby created upon the surface of the dielectric layer which is developed by cascading a standard xerographic developer over the surface of the dielectric layer. The toner image thus produced is transferred by conventional techniques to a sheet of copy paper and any residual toner remaining on the surface of the dielectric removed by wiping with a soft cotton cloth an additional latent image is produced by simply recharging the surface of the dielectric layer as described above followed by blanket exposure of the selenium layer. The latent image is developed in a conventional manner and the above copy sequence repeated several additional times. The only limitation on the number copies that can be produced is the gradual deterioration of the persistent image pattern by recombination of charge carriers within the layer. As long as this image pattern remains intact, multiple copy capability should endure and copy quality should remain relatively constant.

EXAMPLE II

A series of imaging members are prepared as described in Example I. These individual sheets of imaging member are laminated to a continuous electroformed conductive nickel belt. The memory effects in the persistent photoconductive layers are erased by heating the entire belt in the same manner described previously for the individual sheets and the individual sheets thereafter imaged so as to create a series of persistent image patterns. This belt is transferred (still in the dark) to a rapidly cycling xerographic copier/duplicator prototype fixture. The individual sheets are then (in sequence) blanket exposed to activating magnetic radiation whereby the field across the non-persistent photoconductive insulating layer is collapsed thus creating a contrast potential upon the surface of the dielectric coating of the imaging member. This contrast potential is developed as described previously and the toner image transferred to a receiving sheet. The toner residues remaining on the surface of the dielectric layer are removed and the latent image/development/cleaning sequence repeated. This process is carried out on each individual segment of imaging member laminated to the continuous nickel belt. This results in a high speed serial printing system.

What is claimed is:

1. An electrophotographic imaging member consisting essentially of a conductive substrate, a non-persistent photoconductive insulating layer operatively associated with said conductive substrate, a persistent photoconductive insulating layer comprising an acid sensitized charge transfer complex contiguous with the non-persistent photoconductive insulating layer and an unpigmented dielectric film overcoating the free surface of the persistent photoconductive insulating layer.

2. The imaging member of claim 1, wherein the non-persistent photoconductive insulating layer comprises amorphous selenium.

3. The imaging member of claim 1, wherein the unpigmented dielectric film comprises a polyester.

4. The imaging member of claim 1, wherein the relative thickness of the non-persistent photoconductive insulating layer, the persistent photoconductive insulating layer and the unpigmented dielectric film are determined by the desired contrast potential between the light and dark areas of latent electrostatic image on the surface of the unpigmented dielectric film, and being further limited by the individual breakdown field of the individual layers.

5. An imaging method comprising:

a. providing an electrophotographic imaging member consisting essentially of a conductive substrate, a non-persistent photoconductive insulating layer operatively disposed with respect to said substrate, a persistent photoconductive insulating layer contiguous with the non-persistent photoconductive insulating layer and an unpigmented dielectric film overcoating the free surface of the persistent photoconductive insulating layer;

b. exposing the persistent photoconductive insulating layer of said member to a light and shadow image pattern to render said layer persistently conductive for at least about 60 seconds;

c. sensitizing the surface of the dielectric layer of said member by uniform charging in the dark to a constant corona current; and

* * * * *

UNITED STATES PATENT AND TRADEMARK OFFICE

CERTIFICATE OF CORRECTION

PATENT NO. : 4,047,945

DATED : September 13, 1977

INVENTOR(S) : Gustav R. Pfister and David J. Williams

It is certified that error appears in the above-identified patent and that said Letters Patent are hereby corrected as shown below:

Column 8, line 25 (Claim 5) insert:

--(d) subjecting the non-persistent photoconductive insulating layer to blanket exposure, the wavelength of light used in such exposure being substantially not activating of the persistent photoconductive insulating layer.--

Signed and Sealed this

*Fourteenth* Day of *February 1978*

[SEAL]

*Attest:*

RUTH C. MASON
*Attesting Officer*

LUTRELLE F. PARKER
*Acting Commissioner of Patents and Trademarks*